United States Patent [19]

Armantrout et al.

[11] 4,437,672

[45] Mar. 20, 1984

[54] GOLF GAME SIMULATING APPARATUS

[75] Inventors: Robert J. Armantrout; George E. Gerpheide, both of Salt Lake City, Utah; Robert F. Wilson, deceased, late of Salt Lake City, Utah, by Robert D. Wilson, personal representative

[73] Assignee: Robert D. Wilson, Salt Lake City, Utah ; personal representative of Robert F. Wilson, deceased

[21] Appl. No.: 211,622

[22] Filed: Dec. 1, 1980

[51] Int. Cl.[3] ..... A63B 69/36

[52] U.S. Cl. ..... 273/185 B; 273/195 A; 273/181 H

[58] Field of Search ..... 273/317, 318, 348, 87 C, 273/185 B, 181 H, 181 G, 186 R, 186 RA, 2, 4; 434/315; 352/180, 233, 163; 353/85; 200/5 A

[56] References Cited

U.S. PATENT DOCUMENTS

| | | | |
|---|---|---|---|
| 3,501,152 | 3/1970 | Conklin et al. | 273/185 B |
| 3,549,147 | 12/1970 | Katter | 434/22 |
| 3,559,996 | 2/1967 | Hopp | 273/181 H |
| 3,664,037 | 5/1972 | Budnik et al. | 434/315 |
| 3,778,064 | 12/1973 | Nutter | 273/181 H |
| 4,017,085 | 3/1977 | Maxwell | 273/176 FA |
| 4,149,781 | 4/1979 | Everett | 352/180 |
| 4,150,825 | 4/1979 | Wilson | 273/185 B |
| 4,302,647 | 11/1981 | Kandler et al. | 200/5 A |

*Primary Examiner*—Richard C. Pinkham
*Assistant Examiner*—Mary Ann Stoll
*Attorney, Agent, or Firm*—Thorpe, North & Western

[57] ABSTRACT

Apparatus for simulating the playing of golf includes a tee area from which a player may drive a golf ball toward a curved target screen in front of the tee area. Optical sensing devices are positioned to gather data as to the speed and distance of travel of a ball driven from the tee area. With the data from the sensing devices, computer apparatus produces an estimate for display of the distance of travel and ultimate resting position the driven ball would have if allowed free flight. Sensing devices also allow the computer apparatus to determine when a ball falls into a cup located in front of the target screen. If a ball enters the cup, and if the computer apparatus determines that the ball would have landed within a prescribed distance from the location of a target hole towards which the ball is driven, a "holed out" condition is presumed.

20 Claims, 8 Drawing Figures

GOLF GAME SIMULATING APPARATUS

BACKGROUND OF THE INVENTION

This invention relates to apparatus for simulating the playing of a game of golf.

Numerous arrangements have been proposed for providing indoor facilities by which the playing of an outdoor game of golf can be simulated. Such arrangements are considered desirable for a variety of reasons including alleviating the overcrowding of existing outdoor golf facilities, and enabling year-round play in climates where year-round play at outdoor facilities is not possible. Moreover, the use of indoor facilities would typically be less strenuous and less expensive than would the use of outdoor facilities, and would enhance golf instruction and teaching capabilities. The prior art arrangements thus far proposed are discussed generally in U.S. Pat. No. 4,150,825, which patent, in its entirety, is hereby incorporated by reference into this application. The invention disclosed in that patent (U.S. Pat. No. 4,150,8250 was conceived by one of the joint inventors of the improvements disclosed in this application.

In the above referenced patent, a golf game simulating apparatus is disclosed that generally projects a picture onto a screen some 20 feet in front of a player depicting the view the player would have if he or she were actually present on a specified golf course. With the view displayed on the screen as his or her guide, and having some prior information as to the distances and general shape of the particular hole of the specified golf course on which the golfer is playing in simulated fashion, the player selects an appropriate club and drives his golf ball towards the fairway). The ball only travels a short distance (approximately 20 feet) before striking the screen or the surrounding walls and ceiling. These walls, ceiling, or screen are designed to be flexible so as to absorb the impact of the ball striking them and to allow the ball to safely fall to the floor. However, as the ball is in flight, it passes through three defined planes that are constantly being scanned by an infrared detector array. The ball is also appropriately illuminated from an infrared light source as it travels so that it can be detected as it passes through each plane. By combining all the information obtained from all three planar sensors, the exact trajectory of the golf ball can be calculated by computing apparatus. A microprocessor is used for this computing function. Knowing the exact trajectory, the microprocessor is able to compute the exact location where the ball would have gone on the fairway (or around the fairway) of the particular hole where the simulated game is being played. Prior information as to the layout (including distances, rough, bunkers, trees, etc.) is preprogrammed into the microprocessor, thereby enabling it to compute the exact point, within a few feet, where the ball would have landed had it continued in free flight.

Knowing the point where the ball would have landed, the microprocessor controls a filmstrip projector that advances to a new frame of film so as to display to the player a new picture or view as would be seen from the location where the ball "lies" within the simulated fairway. The player then hits the ball again from this new location. The microprocessor computes the trajectory of the ball as before and then advances the filmstrip projector to a new frame depicting the view from the location of the newly computed "lie" of the ball. In this fashion, the player works his way down the simulated fairway, just as in the actual game of golf, until he arrives at the green. When he arrives at the green, the microprocessor lights up a simulated green whereon the player may putt out. The player then advances to the next hole of the simulated golf course.

The simulated golf game apparatus disclosed in U.S. Pat. No. 4,150,825 is advantageously adapted for allowing single players, two-somes, three-somes, or four-somes to play the simulated game. Before beginning a play on a simulated hole, a diagram of the hole typically appears projected on the screen for the players to study. This diagram gives them an idea as to the distances and general shape of the hole, thereby allowing them to properly choose a club. The players may also select whether to tee off from the ladies', mens' or pros' tees. This information is fed into the microprocessor which directs the projector to advance to the picture or scene corresponding to the appropriate tee. That is, a full color picture of the view that would be seen from the tee is projected on the screen. The distance to the "flag" or hole is also shown on a display panel along with the player's name. This player then begins to drive his ball down the simulated fairway as above described.

Using regulation balls and clubs, the player drives, with all the force of his or her natural swing, into the high impact, heat-sealed screen. The distance the ball was hit, the yards it was hit to the right or left, and the amount of hook or slice is immediately shown on the display panel. Should the ball be lost, go out of bounds, or in the water, it will be reported as such.

After each player has played from the tee, the microprocessor determines which player's ball is "away". The projector is then advanced to the appropriate full-color view of the hole and the player is informed, by name, of both the distance remaining in the flat stick as well as the type of area in which his or her ball lies (i.e., fairway, rough, sand, water, lost, out of bounds, etc.). Should the ball land in the sand, the player would play out of the simulated sand trap. If the ball should go into an unplayable area (water, lost, out of bounds, etc.) the rules of golf will apply, and the display panel will inform the player of the lie, the appropriate picture will be projected on the screen, and the microprocessor will add the correct number of strokes. In this fashion, the microprocessor is able to tally the player's score as the game is played and periodically display these scores to the players.

When the players have reached the green, the microprocessor turns off the projector and in sequence turns on the lights that illuminate a putting green positioned in front of the screen. This putting green may typically be contoured like an outdoor green and putts may be made from as far as 20 feet away. After the player has putted out, the display panel will ask for the "number of putts". The player will then enter the number of putts he or she has taken and his or her score will be displayed on the panel. The display panel then instructs the next player to putt out until all the players have finished playing the appropriate hole. The play then advances to the next hole of the simulated game.

As disclosed in U.S. Pat. No. 4,150,825, there are some limitations associated with the simulating process that detract from the realism of the simulated game. First, there is no simple way for resynchronizing the projector with the microprocessor should some sort of miscount (or other failure) occur as the film strip is advancing to a desired picture or film frame that is to be projected on the screen. That is, in the above referenced patent (U.S. Pat. No. 4,150,825), a spot is placed on the film strip corresponding to each frame or picture located thereon. These spots are counted by a spot detector so that the microprocessor will know the number of frames the film has been advanced. The microprocessor has programmed thereinto, of course, which particular frame of the film strip corresponds to a particular count. Thus, when the microprocessor determines that a particular frame is to be displayed, it merely looks up in its memory the frame count for that desired frame and signals the projector to advance that number of frames. However, should the actual count of the frames as projected by the film strip somehow become unsynchronized with the count as sensed by the microprocessor, then an incorrect picture will be displayed. While means are provided in the referenced patent for manually advancing the filmstrip (either by turning a manual advance knob, or by pressing a forward button or a backward button), there really is no method disclosed for efficiently resynchronizing the microprocessor with the frame count.

Another problem associated with the apparatus and circuitry disclosed in the above referenced patent is the manner of driving or advancing the filmstrip to the proper frame. A dc motor is disclosed in the referenced patent that may be either moved in a forward or backward direction. However, the speed with which the motor advances is relatively constant (there being no method disclosed for increasing the motor drive current (or motor voltage). Also, there is no method disclosed for zeroing in on the proper frame so that the picture that is ultimately displayed will be properly framed on the screen.

Other problems or shortcomings of the golf game simulating apparatus disclosed in U.S. Pat. No. 4,150,825 are the lack of provisions for a "holed out" condition. That is, as sometimes occurs in the real game of golf, as a person approaches the green, his ball may strike the green and roll into the cup, thereby eliminating the need to putt-out on that particular green.

Still another limitation associated with the golf game simulating apparatus previously disclosed in U.S. Pat. No. 4,150,825 is the manner of entering date into the microprocessor. In that patent, several manual switches are disclosed for informing the microprocessor of the desired tee (mens', ladies', or pros'), whether the front or back nine holes are desired to be played, whether eighteen holes are desired to be played, or whether a driving range is desired. In order to make the game more realistic, it would be desirable to allow more and varied information to be entered into the microprocessor. Such information would ideally be entered into the microprocessor through a medium that is compatible with an indoor recreational environment. That is, it should not be easily damaged by having liquids fall thereupon (as when a player might spill a drink), and it should be relatively shock resistant (should a player accidentally bump it with his golf club or kick it in a show of anger).

SUMMARY OF THE INVENTION

It is a general object of the present invention to provide improvements to the apparatus disclosed in U.S. Pat. No. 4,150,825 so as to make the simulated game more realistic.

It is a specific object of the present invention to provide improvements to a golf game simulating apparatus such as that disclosed in U.S. Pat. No. 4,150,825 to allow the desired frame of the filmstrip to be speedily and accurately located.

It is a further object of the present invention to provide a means for readily resetting or resynchronizing the film located in the projector with the microprocessor that controls the projector.

It is another object of the present invention to improve the circuitry that drives the filmstrip projector so that it can be realized in a simple and inexpensive fashion.

It is still another object of the present invention to provide in a golf game simulating apparatus a provision whereby a player may "hole out" if the microprocessor determines that the trajectory of his ball could come within a specified distance of the cup and if the ball actually falls into the cup.

It is still a further object of the present invention to provide a mechanism for entering a wide variety of data into the microprocessor that controls the simulating apparatus that is compatible with the indoor recreational environment.

The above and other objects of the invention are realized in a specific illustrative embodiment which includes improvements to the apparatus disclosed in U.S. Pat. No. 4,150,825. Specifically, the motor 152 of that patent is replaced with a stepper motor that is controlled by an improved circuitry over the projector control circuitry 154 disclosed in the referenced patent. This circuitry includes reset capability that allows the microprocessor to resynchronize the frame count so as to insure that a proper picture will be projected. The circuitry also allows the stepper motor to be controlled from the microprocessor so that it can accelerate to a high rate of speed, maintain this speed until it appraoches the desired frame, and then begin to slow down until the desired frame is reached, at which time the stepper motor is stopped. Should there be some overshoot from the desired frame, the circuitry, in combination with the microprocessor, is adapted to automatically align the frame so that the entire picture is properly displayed on the screen.

Provisions are also employed in accordance with one aspect of the invention to allow a player to "hole-out". Specifically, a ball cup detector detects whenever a ball falls in the cup and signals the microprocessor of same. If this signal is present, and if the microprocessor has computed that the ball would have fallen within a specified distance from the cup, then a "hole-out" condition is presumed. Accordingly, the player would not have to "putt-out" for that particular hole. Accordingly, for the relatively short (typically par-three) holes of the simulated golf course, it would be possible (although not very probable) for a player to hit a "hole-in-one".

In accordance with another aspect of the invention, an accurate and reliable mechanism is employed for entering a wide variety of data into the microprocessor. This data entry method allows the microprocessor to ask questions of the players and allows the players to make appropriate responses. For instance, not only can the names of the players be entered (thereby eliminating the need for identifying the players by number), but also other valuable information can be entered into the system (such as the number of strokes required to "putt-out"). This data-entry mechanism is advantageously adapted for the rugged indoor recreational environment in which is would be used.

BRIEF DESCRIPTION OF THE DRAWINGS

The above and other objects, features, and advantages of the present invention will become more apparent from a consideration of the following detailed description presented in connection with the accompanying drawings in which.

DETAILED DESCRIPTION

The invention as disclosed herein is best understood by reference to the figures wherein like parts are designated with like numerals throughout.

Figure 1:
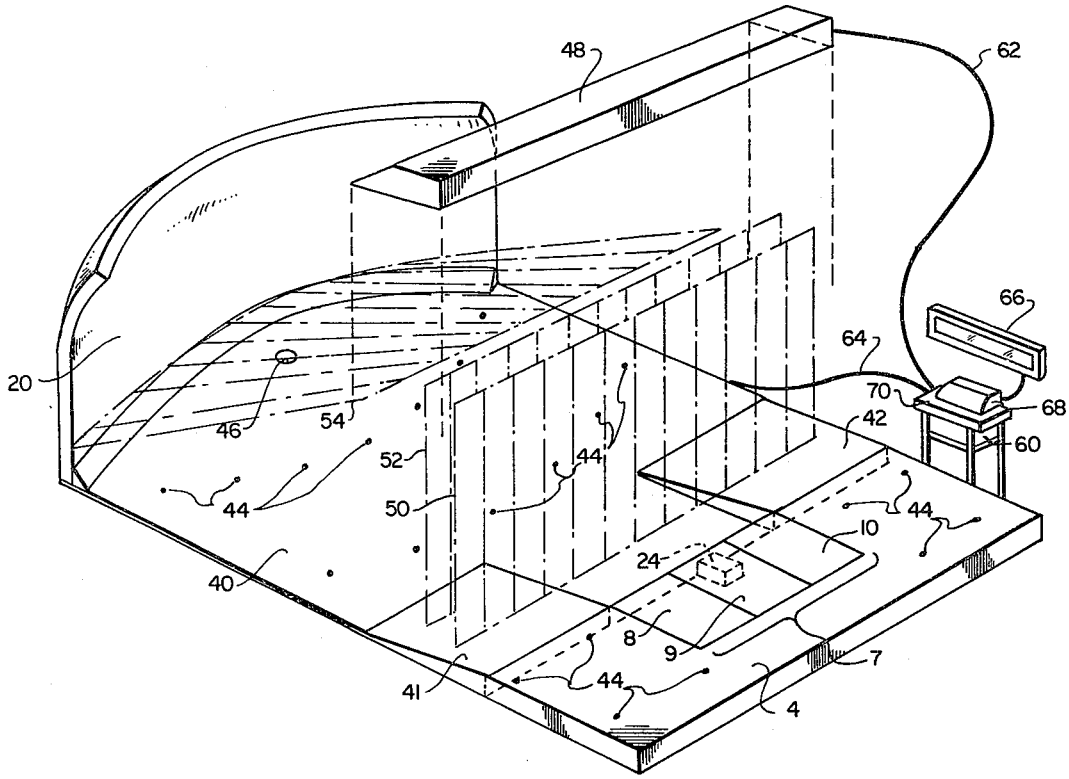
FIG. 1 shows a perspective diagramatic view of a golf game simulating apparatus constructed in accordance with the principles with the present invention.

FIG. 1 depicts, in perspective format, a diagramatic representation of the main elements that comprise the invention. In this respect, FIG. 1 is primarily a summary of the apparatus disclosed in the aforesighted U.S. Pat. No. 4,150,825. Included in this embodiment is a support or platform 4 defining a tee area 7 from which a golf ball may be driven by a player utilizing a golf club. The tee area is divided into three sections 8, 9, and 10, each section being provided with a carpet or other brush-like mat on the upper surface thereof to simulate outdoor areas from which a golfer might hit a golf ball.

Located in front of the tee area is a target screen 20 for receiving balls hit from the tee area and for displaying views projected thereon by a projector 24. The projector 24 is advantageously positioned underneath the platform 4. The target screen 20 is constructed and positioned so as to cause a driven golf ball to deflect generally downwardly at a speed considerably less than the speed at which the ball strikes the screen.

Advantageously, the tee area and screen are disposed in an enclosure having a pair of generally vertical side walls (not shown), a top wall (not shown), and a bottom wall or floor 40. The bottom wall of floor 40 is carpeted to simulate the putting green of a golf course. This simulated putting green extends up ramps 41 and 42 to areas surrounding the tee area 7. Located at different locations on the floor 40 and the platform 4 are spots or markers 44. Each of the spots 44 are identified by some sort of label so that a player can be directed to place his ball thereon when the time comes for him to putt-out. The ramps 41 and 42 are employed so as to add some contour to the simulating putting surface so as to make it more realistic.

A ball cut 46 is positioned towards the front of the floor 40 a short distance from the screen or target 20.

A ceiling light structure 48 includes at least 3 photosensor arrays that respectively define planes 50, 52, and 54. Planes 50 and 52 are vertical planes, whereas plane 54 is an inclined plane. These 3 photosensor arrays that define the planes 50, 52, and 54 are of the type generally dsiclosed in the aforecited U.S. Pat. No. 4,150,825. These arrays are activated only by light traveling to the arrays in the respective planes.

Included in the ceiling light structure 48 are also infrared light sources to illuminate the golf ball as it passes through the planes 50, 52, and 54. Because an infrared light source is used, neither the light source itself, nor the planes 50, 52, and 54, are visible to the naked eye. Thus, there are no distractions for the player standing on the tee area 7 that might adversely affect his play of golf. The planes 50, 52, and 54 are depicted in FIG. 1 with dotted lines so as to represent the fact that they are not visible to a player of the game.

The ceiling light structure 48 is connected to a microprocessing unit 60 via a cable 62. Another cable 64 connects the microprocessor 60 to the ball cup detecting circuitry (to be discussed below). A message board or display 66 is also coupled to the microprocessing unit 60. A data entry device 68 likewise is coupled to the microprocessing unit. In FIG. 1, the data entry device 68 is advantageously shown as being positioned on a table 70 (or other similar stand) located to the side of the raised platform 4. The microprocessing unit 60 is shown as being housed on the underneath side of this table or stand 70. However, it is to be understood that the microprocessing unit 60, as well as the data entry device 68 and the message board 66 could be positioned in any convenient location. For example, it may be desirable that the microprocessing unit 60 be placed adjacent to or inside of the ceiling light structure 48, thereby reducing the length of the cable 62 that connects the sensor arrays and light sources located within the light structure 48 to the microprocessing unit 60.

Figure 2:
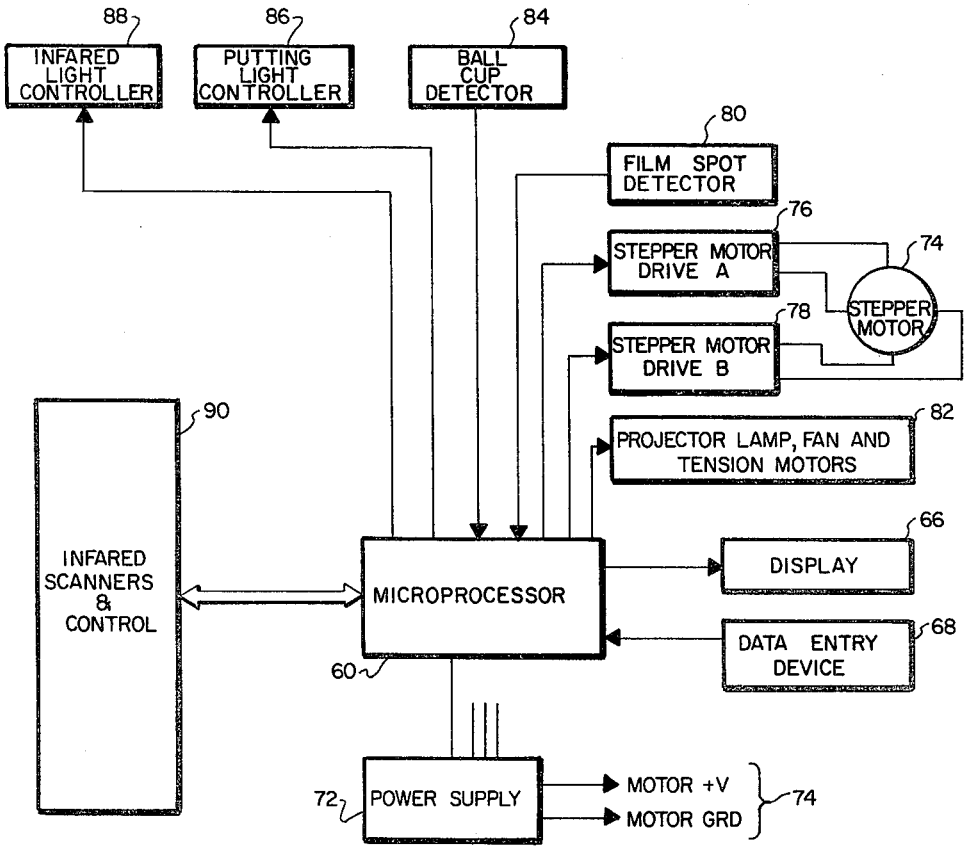
FIG. 2 is a block diagram showing the interrelationship of the principal electrical and/or electromechanical elements of the apparatus.

Referring next to FIG. 2, there is shown a block diagram showing the interrelationship of the principal electrical and/or electromechanical elements of the invention. The heart of the system is, of course, the microprocessing unit 60. The microprocessing unit 60 is powered from a power supply 72 which provides power to all of the other systems used in connection with the invention. A special power circuit 74 is generated by the power supply 72 for powering a stepper motor 74, as well as associated stepper motor drive circuits 76 and 78 employed within the projector 24. Also included within the projector 24 is a film spot detector circuit 80. This film spot detector circuit is adapted to sense the spots located by each frame of the film and to forward this information to the microprocessing unit 60. Also controlled by the microprocessing unit 60 are the projector lamp, fan, and tension motors of the projector 24. These elements are shown in block 82 of FIG. 2. The tension motors of block 82 of FIG. 2 should not be confused with the stepper motor 74. The tension motors are equivalent to motors 260 and 264 of U.S. Pat. No. 4,150,825 and are used to maintain a tension of the film placed within the projector 24.

A ball cup detector 84 is also employed with the improvements disclosed herein and is coupled to the microprocessor 60. The function of the ball cup detector is to sense when a ball falls into the cup 46, and will be described more fully below in connection with FIG. 3 and FIG. 7.

A putting-light controller 86 and an infrared light controller 88 are controlled by the microprocessing unit 60. These controllers turn on the putting lights and infrared lights at the appropriate time. That is, when the player is driving his ball down the simulated fairway, the infrared light controller 88 is energized so as to turn on the infrared lights located within the light structure 48, thereby allowing the flight of the golf ball to be illuminated so that it can be detected as it passes through the planes 50, 52, and 54. After the player has driven his ball down the fairway and has arrived at the green, the infrared light controller 88 turns off the infrared lights and the putting light controller 86 turns on the putting lights, thereby allowing the player to place his ball on a designated spot on the putting surface 40 and putt out.

The infrared scanners and controls thereof are represented by block 90 in FIG. 2. The operation and control of the infrared scanners is the same as that disclosed in U.S. Pat. No. 4,150,825 and accordingly will not be further described in this application. The operations of the infrared light controller 88, the putting light controller 86, and the power supply 72 will likewise not be discussed further in this application inasmuch as these elements have previously been described in U.S. Pat. No. 4,150,825 or can readily be realized by those skilled in electronic art.

Figure 3:
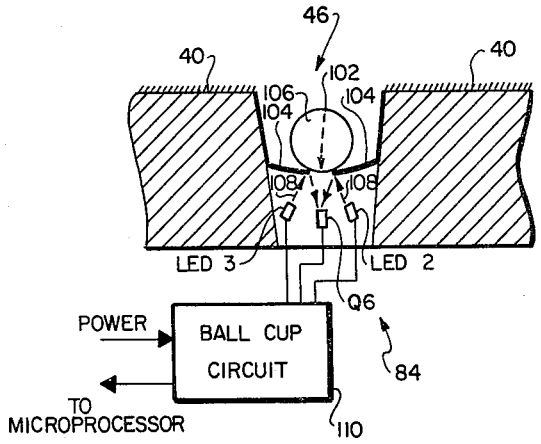
FIG. 3 shows a representation of the ball cup detector of FIG. 2, including a sectional view of the cut into which the golf ball is hit.
Figure 7:
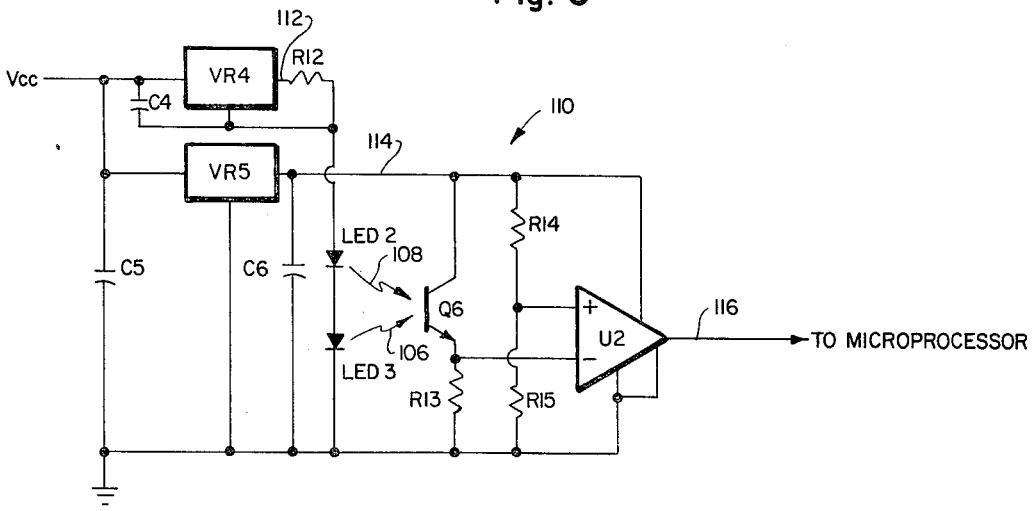
FIG. 7 is an electrical schematic diagram of the ball cup detector circuitry of FIG. 2.

Referring next to FIGS. 3 and 7, the operation of the ball cup detector 84 will be described. At least one hole 102 is placed in the center of the bottom of the cup 46. The bottom surface of the cup 46 is generally concave so that a ball 106 that falls into the cup 46 will ultimately come to rest in the center of the hole. Two light-emitting diodes, designed as LED 2 and LED 3 are positioned underneath the cup 46 so as to direct a suitable beam of light 108 through the hole 102. Whenever a ball 106 falls into the cup 46, the ball blocks the hole 102 and causes the light 108 to be reflected back to a photosensitive transistor Q6. Thus, whenever a ball 106 is in the cup 46, the photosensitive transistor Q6 will be activated. When the ball 106 is removed from the cup 46, then the transistor Q6 will not be activated. A ball cup circuit 110 activates LED 2 and LED 3 as well as monitors the status of the photosensitive transistor Q6. Two light-emitting diodes are utilized to activate Q6 so as to account for the wide variation of colors that may exist on a given golf ball. That is, for a bright, clean golf ball, the light emitted from one of the LED sources would be sufficient to activate Q6. However, for a dirty (or otherwise dull) golf ball, the light emitted from both of the LED sources may be required to activate Q6. In other words, by employing two sources of light rather than one, a system is provided that insures that the presence of the golf ball in the cup 46 will be detected.

In FIG. 7, the details of the ball cup circuit 110 are depicted. Two voltage reference sources, VR4 and VR5, are employed to respectively generate two stable reference voltages from the supply voltage $V_{CC}$. The reference voltage generated by the voltage reference VR4 appears at signal line 112 and is connected through resistor R12 and LED 2 and LED 3. Resistor R12 thereby controls the amount of current that passes through these two light-emitting diodes. The output of the voltage reference VR5 appears at signal line 114. This voltage is applied to the collector of the photosensitive transistor Q6 and to a comparator circuit U2. A voltage dividing network formed by resistors R14 and R15 is also connected between this voltage and ground. The divided voltage appearing between resistors R14 and R15 is applied to the positive input of the comparator circuit U2. Another resistor R13 is connected between the emitter of Q6 and ground. The emitter of Q6 is also connected to the negative input of the comparator U2. Capacitors C4, C5, and C6 are used to filter and otherwise add stability to the voltage reference circuits VR4 and VR5 and the output voltages generated therefrom.

In operation, when there is no ball 106 present within the cup 46, the transistor Q6 will be off (meaning that no current will be flowing therethrough). Accordingly, the emitter of Q6 and the negative input of the comparator U2 will be approximately at ground potential. Thus, the output of the comparator circuit will be high because the positive input thereto will be a positive reference voltage generated by the dividing circuit formed by the resistors R14 and R15, which positive reference voltage is higher than the voltage at the negative input of U2.

When a golf ball 106 is present within the cup 46, then the light 108 generated by LED 2 and LED 3 will be reflected to the photosensitive transistor Q6, thereby allowing Q6 to turn on. With Q6 on, the emitter at the voltage will raise to a point above the reference voltage at the positive input of the comparator circuit U2. With the negative input at a higher voltage than the positive input, the output of U2 will go low. This output appears on signal line 116 and is routed to the microprocessing unit 60. The microprocessing unit 60 monitors the signal line 115 to determine when a low condition exists. As explained above, if a low condition is present, and if the microprocessor has determined that the trajectory of the ball would have carried it to within a specified distance (typically a yard) of the hole, then a "hole-out" condition is declared.

The voltage regulators VR4 and VR5 may be realized using a three-terminal positive voltage regulator such as the 78L00 series manufactured by Signetics, Fairchild Semiconductor, or other semiconductor manufacturers. The regulator VR4 could illustratively be realized using a 78L02 (2.6 volts) and the regulator VR5 could be a 78L05 (5 volts). The comparator circuit U2 could be realized with an LM311 manufactured by National Semiconductor (as well as numerous other semiconductor manufactuers). The light-emitting diodes LED 2 and LED 3 could both be realized with a TIL32 manufactured by Texas Instruments, Inc. The photosensitive transistor Q6 could be realized using a TIL78 also manufactured by Texas Instruments, Inc.

Figure 4:
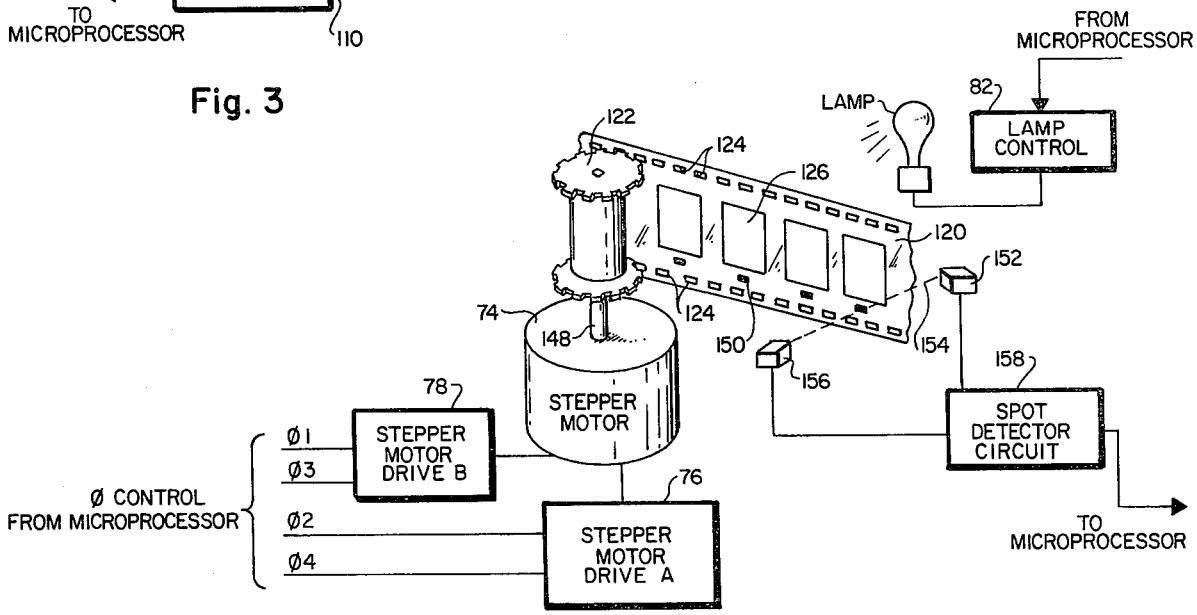
FIG. 4 represents filmstrip drive apparatus used in connection with the stepper motor and film spot detector of FIG. 2.
Figure 8:
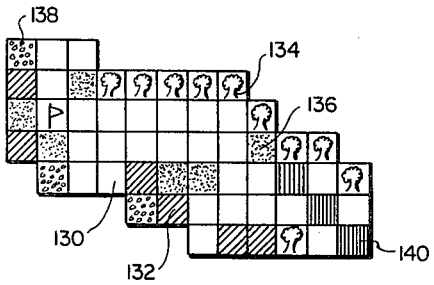
FIG. 8 is a typical golf hole as programmed into the microprocessor of FIG. 2.

Referring next to FIG. 4, there is represented in diagramatic form a filmstrip drive apparatus that could be used in connection with the projector 24. Film 120 is moved between two spools or rolls by causing a sprocket device 122 to rotate. The sprockets of the device 122 are adapted to engage or mate with corresponding sprocket holes 124 located long the edges of the film 120. By rotating the sprocket device 122, the film 120 is thereby caused to move in a forward or reverse direction. Each frame 126 of the film 120 contains a photograph of a particular view from a particular golf course. A large number of frames or pictures 126 would be included on a given roll of film 120. For example, referring for a moment to FIG. 8, there is shown a typical layout of a fairway as programmed into the microprocessing unit 60. As seen in FIG. 8, the fairway is broken down into a grid structure, with each grid being a suitable distance. For example, each grid shown in FIG. 8 could be 33⅓ yards square. For purposes of the discussion here, there is located on the film 120 a picture of frame 126 corresponding to each grid of the particular fairway being played. This picture 126 is typically an actual photograph taken from an actual golf course from the center of the grid looking towards the green. It will be seen that there are 56 grids shown in FIG. 8, meaning that at least 55 different pictures or photographs would be needed to display the various views looking towards the green (represented by the grid having the small flat therein). If 55 photos represent an average number of photos required per hole, then for an 18 hole golf course there would need to be around 1,000 different pictures or photos included on the film 120.

Also in connection with FIG. 8, it should be observed that each grid is designated as belonging to a particular category. That is, the blank grids in FIG. 8, such as 130, represent the fairway. The slanting cross-hatch grids, such as 132, may represent "rough". Similarly, the grids with a tree structure drawn therein, such as 134, would represent trees. The grids such as 136 having small dots drawn therewithin could represent bunkers or sand traps. Similarly, the grids having small circles therein, such as 138, could represent an area that is out of bounds. Finally, the grids having the vertical cross-hatch, such as 140, would represent the various tees that could be selected by the players, the closest tee to the green representing the ladies', the middle tee representing the mens' tee, and the farthest tee away from the flag representing the professionals' tee. Other types of markings could be employed, of course, to represent other hazards or conditions, such as a water hazard. It should be emphasized that while the grids represent a relatively large cross-sectional area, the microprocessor computes the location of the ball within a specific grid very accurately (typically within a yard). Thus, the picture displayed on the screen 20 (which will always be a picture as viewed from the center of a given grid looking towards the flag) may represent a slightly different view as would be observed from the precise location of the player's ball. However, by knowing the location of the ball, which location is displayed to the player on the display board 66, the player can quickly compensate for this slight discrepancy. Of course, the particular fairway could be broken into smaller and smaller grids, with each grid containing an additional photograph. However, it is felt that a trade-off is quickly reached relative to the complexity of the system and the number of pictures required on the film 120 versus the accuracy of the picture displayed. Grids of around 33⅓ yards square have been determined by the inventors to represent an appropriate compromise to this trade-off.

Referring back to FIG. 4, there is associated a small, generally rectangular shape, spot 150 with each frame 126 on the film 120. A source of light 152 generates a ray of light 154 that is aligned so as to pass through (or be blocked by) the respective spots 150. A light detector 156 is placed on the other side of the film 120 from the light source 152 so as to receive the beam of light 154 when it is not blocked by the spots 150. A spot detector circuit 158 energizes the light source 152 and senses the status of the light detector 156.

A stepper motor 74 drives the sprocket device 122. The stepper motor is controlled by two stepper motor drive circuits, stepper motor drive "A", 76, and stepper motor drive "B", 78. The shaft 148 of the stepper motor 74 is adapted to rotate a fixed distance for every energizing step received from the drive circuits 76 or 78. In order to achieve a high degree of resolution, a stepper motor having a small angle per step may advantageously be used, thereby eliminating the need for costly and cumbersome gearing between the shaft 148 and the sprocket device 122. An exemplary stepper motor would have a shaft rotation of 3° per step. The sprocket device 122 could then be designed so that a 180° revolution advances the film 120 a distance of one frame. Accordingly, the stepper motor 74 would need to be advanced 60 steps in order to advance the film 120 a distance of one frame.

Other details associated with the operation of the projector 24 may be the same as is known in the art or as is disclosed in U.S. Pat. No. 4,150,825. For example, the details associated with the reels on which the film 120 is housed, as well as the particular structure that maintains the film in its desired taut condition, as well as the lens system of the projector, will not be discussed herein.

Figure 5:
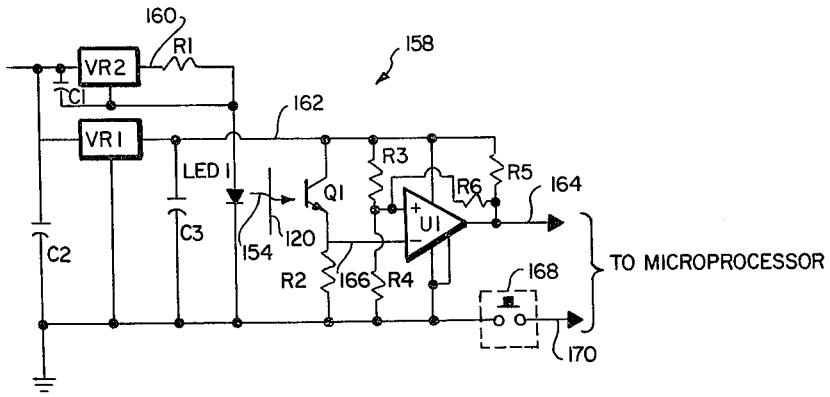
FIG. 5 is an electral schematic diagram of the film spot detector of FIG. 2.

Referring next to FIG. 5, an electrical schematic diagram of the spot detector circuit 158 is shown. This circuit is very similar to the ball cup circuit 110 shown in FIG. 7. Two voltage reference circuits, VR1 and VR2 generate respective reference voltages appearing on signal lines 160 and 162. Resistor R1 is connected to the reference VR2 and controls the amount of current flowing through a light-emitting diode LED 1. LED 1 thus serves as the light source 152 discussed in connection with FIG. 4. The light 154 is directed through the film 120 to a photosensitive transistor Q1. Q1 thus serves as the light or optical sensor 156 discussed in connection with FIG. 4. Resistors R3 and R4 form a voltage dividing network that generates a reference voltage applied at the positive input of a comparator circuit U1. This reference voltage is further modified by resistor R6 which is connected between the output of U1, appearing on signal line 164, and the positive input thereof. Resistor R2 is connected between the emitter of Q1 and ground, thereby serving the same function as resistor R13 in FIG. 7. This emitter of Q1 is connected to the negative input of comparator U1 over signal line 166. Capacitors C1, C2, and C3 serve the same function as capacitors C4, C5, and C6 respectively of the ball cup circuit 110 shown in FIG. 7.

A reset button 168 forms part of the spot detector circuit 158 by allowing a momentary contact to be made to ground. When this reset button 168 is pushed, the ground potential appearing on signal line 170 signals the microprocessor to rewind the film 120 back to the first frame so that the microprocessor counting apparatus (typically a register) can be reset to a desired beginning count.

In lieu of the reset button 168, or in addition thereto, it would be possible to encode a series of spots associated with each frame of the film so that the frame number could be immediately determined from the sequence of spots (or other encoding scheme) detected in connection with each frame. Alternatively, an encoded arrangement of spots could be placed regularly throughout the film 120, such as every 10 or 20 frames, to regularly identify a specific frame number so that resynchronization could occur without having to rewind the film back to the beginning frame. However, these methods of encoding a specific frame number by each frame (or spaced between several frames) would greatly increase the complexity of the sensing circuitry required. By using the single spot 150 as shown in FIG. 4, the sensing circuitry is very simple, as is the tracking circuitry within the microprocessor (which need only be a counter which is incremented or decremented as the spots are sensed).

In operation, the spot detector circuit 158 of FIG. 5 produces a low signal on signal line 164 whenever a spot 150 blocks off the beam of light 154. At all other times, the signal on line 164 is high. This is because when the spot does not block the light 154, the transistor Q1 is activated, which in turn raises the voltage on line 166 to a level exceeding the voltage on the positive input to the comparitor U1. With the negative input of U1 higher than the positive input, the output thereof is forced to a low level.

As a spot 150 begins to move in front of the transistor Q1, Q1 begins to turn off, thereby lowering the voltage on line 166. A threshold point is reached where the voltage on the negative input of U1 is approximately equal to the positive reference voltage. At this time, the output of U1 begins to go high. As it goes high, the reference voltage at the positive terminal of U1 is also pulled higher because of the presence of resistor R6. The net result is that the switching of the output signal on 164 is a clean sharp signal that is free from all transients that might otherwise be interpreted as a false count. Note that resistor R5 serves as a pull-up resistor to the output of the comparator circuit U1, thereby allowing resistor R6 to influence the reference voltage at the positive terminal of U1 in the desired fashion when the output of U1 is high.

LED 1 may be realized using a TIL231-2 manufactured by Texas Instruments. The photo transistor Q1 may be realized using a TIL78 also manufactured by Texas Instruments. The regulators VR1 and VR2, as well as the comparator circuit U1, may be realized using the same respective components that are used in the ball cup circuit 110 shown in FIG. 7.

Figure 6:
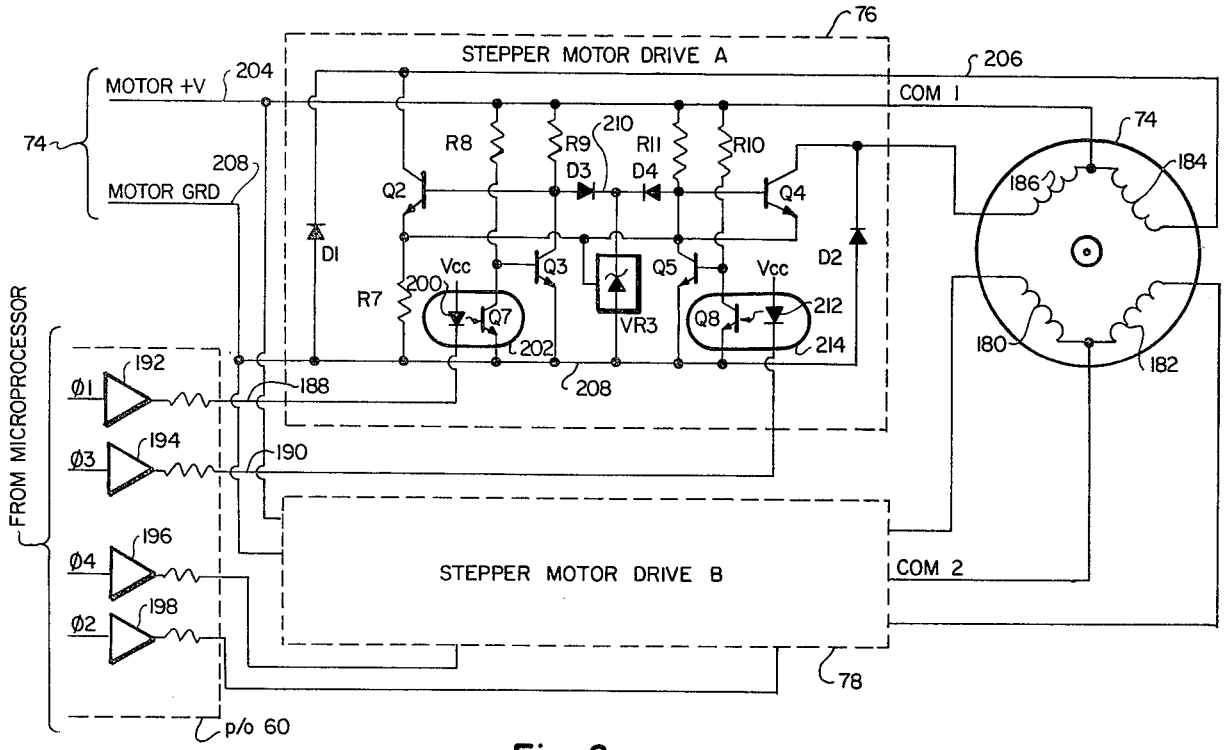
FIG. 6 is an electrical schematic diagram of the stepper motor drive circuits of FIGS. 2 and 4.

Referring next to FIG. 6, there is shown an electrical schematic diagram of the stepper motor drive "A" circuit 76. The stepper motor drive "B" circuit 78 is identical to the circuit 76 so only the circuit 76 is shown.

Before describing the details of the stepper motor drive circuit 76, it will be helpful to briefly review stepper motor operation. A stepper motor typically has a multi-pole permanent magnet rotor. Several stator windings are uniformly spaced around the rotor. By selectively energizing the stator windings, a rotating magnetic field or fields are set up onto which the permanent magnet rotor can lock. The stepper motor 74 used in connection with the preferred embodiment of the present invention is referred to as a four-phase stepper motor. This means that it has four stator windings 180, 182, 184, and 186. Each time a phase of the stepper motor is energized, the rotor (or shaft which is connected to the rotor) is caused to rotate one step. For the preferred embodiment, one step corresponds to a 3° revolution. Because the amount of rotation associated with each step is relatively small, a relatively large amount of torque can be developed at the shaft of the stepper motor 74.

To understand the operation of the stepper motor drive circuit 76, an explanation will now be given of how the coil 184 of the stepper motor 74 is energized, which energization causes the stepper motor to rotate one step. Included as part of the microprocessing unit 60 are four driver circuits 192, 194, 196 and 198. These could typically be open collector inverter circuits realized with a TTL 7406 or equivalent. Each of these inverter circuits corresponds to one of the phases of the stepper motor 74. The inputs to these inverter circuits are labeled Ø1, Ø3, Ø4, and Ø2 respectively. When the input Ø1 to gate 192 goes high, the output is caused to go low. This enables current to flow through the LED 200 that is included within the optical coupler 202. A phototransistor Q7, also part of the optical coupler 202, is thereby energized. The collector of Q7 is tied to the base of a transistor Q3. A resistor R8 connects this collector of Q7 to a positive motor voltage supply 204. Thus, when Q7 is energized by enabling current to flow through the LED 200, the collector of Q7 is pulled to ground, thereby turning transistor Q3 off. With transistor Q3 turned off, a drive transistor Q2 may be turned on by allowing base current to flow into the base terminal thereof through resistor R9. With the drive transistor Q2 turned on, motor current is allowed to flow through the coil 184 from the positive motor voltage source 204 through the coil 184 along signal line 206, through the driver transistor Q2 and resistor R7 and to the motor ground return line 208. The amount of motor current that is allowed to flow through the coil 184 is set by the voltage regulator VR3. That is, whenever the transistor Q3 is turned off, the voltage regulator VR3 may be energized through the resistor R9 and diode D3, thereby placing a fixed voltage at the point 210. The base of the transistor Q2 will be one diode potential above the voltage generated by the regulator VR3 at 210. The voltage at the emitter of the driver transistor Q2 is one diode drop below the voltage at the base thereof. Hence, the voltage at the emitter terminal of Q2 is approximately equal to the refrence voltage generated by the regulator VR3 appearing at 210. Thus, a fixed voltage is developed across the resistor R7, thereby forcing a fixed current (in accordance with Ohm's Law) to be pulled through the driver transistor Q2 and the coil 184.

A fixed motor current is pulled through the coil 186 in an identical fashion to that above described in connection with coil 184 except that the current is pulled through driver transistor Q4 in response to signal line 190 going low as steered by the Ø3 signal. That is, when signal line 190 goes low, an LED 212 located within an optical coupler 214 energizes a phototransistor Q8 also located within the coupler 214. When Q8 turns on, the transistor Q5 is turned off, thereby allowing the driver transistor Q4 to turn on and pull a fixed current from the positive motor voltage line 204 through the motor coil 186, through the transistor Q4, and to the motor return line 208 through the resistor R7.

In a similar fashion to that above described in connection with the stepper motor drive circuit 76, the stepper motor drive circuit 78 energizes the windings 180 and 182 of the stepper motor 74. The winding 180 would have a fixed current pulled therethrough in response to the signal Ø4 at the input of gate 196 going high. Similarly, the coil 182 would have a fixed current flow therethrough in response to the signal Ø2 at the input of gate 198 going high.

The advantage of using a stepper motor 74 is the relative simplicity with which a high degree of resolution can be obtained. As described previously, in the preferred embodiment the stepper motor 74 must step 60 steps (180°) in order to advance the film one frame. Moreover, the stepping rate, or frequency of the step signals appearing at the Ø1, Ø3, Ø4, and Ø2 inputs to the gates 192, 194, 196, and 198 may be varied in order to meet the torque and speed requirements of the stepper motor 74. That is, if the stepper motor 74 has to advance the film from frame No. 50, for example, to frame No. 550, then the microprocessor would gradually increase the frequency of the Ø1, Ø3, Ø4, and Ø2 frequency signals so as to cause the stepping motor to accelerate to a maximum speed. After the film has advanced to within a given number of frames from the desired frame, the microprocessor would begin to decrease the frequency of the phase signals Ø1, Ø3, Ø4, and Ø2. Thus, the stepper motor 74 would slow down until the desired frame was obtained. Once the film stops, the microprocessor 60 is programmed to slowly advance the film until the next spot 150 is detected. The stepper motor 74 then automatically backs up a pre-determined number of steps so that the correct frame will be projected upon the screen. In this fashion, a desired frame can be quickly located within the film 120 and the alignment thereof can automatically be made by the stepper motor 74 in response to stepping signals received from the microprocessing unit 60. It is significant to note that because of the use of the resistor R6 in the spot detector circuit 158 (FIG. 5), a very defined and precise point can be determined wherein the spot 150 is properly aligned with the light source 152 and the light sensor 156. Moreover, because the stepping motor 74 only rotates 3° (1/60th of a frame) in response to a single step command, a high degree of alignment accuracy can be achieved. Once the frame is properly aligned as determined by the spot detector circuit 158 and the microprocessor 60, the projector lamp may be energized, thereby projecting a picture of the desired frame on the screen 20.

In the preferred embodiment, the stepper motor 74 may be realized with a model M-061-FD-6008 stepper motor manufactured by Superior Electric Co., Brystol, Conn. The drive transistors Q2 and Q4 may be realized using a Darlington NPN TIP111, manufactured by Texas Instruments. The transistors Q3 and Q5 may be realized using any suitable switching transistor, such as the 2N2222 manufactured by numerous semiconductor manufacturers. The optical couplers 202 and 214 can be realized utilizing a TIL114, also manufactured by Texas Instruments. The voltage regulator VR3 can be realized with a TL430C manufactured by Texas Instruments. The diodes D3 and D4 could be any suitable blocking diode such as a 1N914. Diodes D1 and D2, which are used as protection devices against excessive back emf voltages generated by the motor, may be realized using a 1N4002 rectifier diode.

The data entry device 68 should be fabricated so as to be compatible with the recreational environment wherein it is used. Accordingly, it should not only be resistant to moisture, but also to mechanical shock. Several types of switches could be used for this function. A capacitive switch keyboard device, wherein there are no moving parts, was initially used for this purpose. However, static discharge could easily cause improper data entry. A more suitable data entry device has been determined to be a membrane switch. Such a switch actually functions from mechanical pressure placed on each individual key. However, the entire unit is sealed and extremely simple, thereby making it moisture resistant and capable of withstanding severe mechanical shocks. A suitable membrane switch keyboard is manufactured by numerous keyboard and other switch manufacturers.

While the invention herein disclosed has been described by means of specific embodiments and applications thereof, numerous modifications and variations could be made thereto by those skilled in the art without departing from the spirit and scope of the present invention. It is therefore to be understood that within the scope of the appended claims, the invention may be practiced otherwise than as specifically described herein.

What is claimed is:

1. Apparatus for simulating the playing of golf comprising:

a support defining a tee area from which a golf ball may be driven by a player utilizing a golf club;

a target screen disposed in front of the tee area for receiving balls driven from the tee area and from which balls will rebound;

first sensor means including means for calculating the speed of a ball and including means for detecting the direction of travel of said ball driven from the tee area toward the screen;

first computing means (response) responsive to said first sensor means for producing an estimate of the distance of travel and ultimate resting position the driven ball would have if allowed free flight;

a cup disposed in front of the tee area close to said target screen into which rebounded balls may fall, said cup having an upper rim that is generally flush with a floor surface placed between said target screen and tee area support;

second sensor means for detecting when a ball falls into said cup; and logic means for indicating a holed-out condition when said second sensor means detects a ball in said cup and when the first computing means determines that the ultimate resting position of the driven ball is within a predetermined distance from a golf hole location, said golf hole location being representative of the location of a simulated golf hole towards which the player has driven the golf ball.

2. Apparatus as defined in claim 1 further including:

projector means for projecting images from changeable film frames onto the target screen for viewing by the player;

film frames for said projector means, each frame having a scene of the golf hole taken from a different location spaced from the golf hole; and second computing means for signaling said projector means to project a scene representative of the location nearest the position the first computing means estimated the driven ball came to rest.

3. Apparatus as defined in claim 2 wherein said second sensor means comprises:

a light source disposed beneath a hole located in the bottom of said cup, said light source being positioned so as to direct a beam of light out through said hole;

an optical sensor spaced apart from said light source and positioned beneath the bottom of said cup so that blockage of said hole in the bottom of said cup causes said beam of light to be reflected towards said optical sensor; and cup detector control circuitry for energizing said light source, and for monitoring the status of said optical sensor and signaling said logic means whenever the optical sensor senses said beam of light, thereby indicating the blockage of said hole.

4. Apparatus as defined in claim 3 wherein the bottom of said cup is concave as viewed from the top of said cup and further wherein said hole is located in the center of said bottom, whereby a golf ball falling into said cup rolls to the center of the bottom thereof and blocks said hole, causing said beam of light to be reflected towards the optical sensor.

5. Apparatus as defined in claim 4 further including at least one additional light source disposed below the bottom of said cup and positioned so as to direct a beam of light out through said hole, said additional light source being spaced apart from said optical sensor and said light source so that any blockage of said hole causes the respective beams of light from said light source or said additional light source to be reflected towards said optical sensor.

6. Apparatus as defined in claim 5 wherein said light sources each comprises a light emitting diode and said optical sensor comprises a photosensitive transistor responsive to the light emitted by said light emitting diodes.

7. Apparatus as defined in claim 2 wherein said projector means comprises:

a lamp that is selectively energized in response to a lamp control signal received from said second computing means;

drive means responsive to said second computing means for moving a selected one of said film frames in front of said lamp; and frame detection apparatus for detecting the passage and position of one of said film frames in front of said lamp and for signaling said second computing means of such passage and position.

8. Apparatus as defined in claim 7 wherein said film frames are placed in a spaced apart relationship on a roll of film.

9. Apparatus as defined in claim 8 wherein said frame detection apparatus comprises:

a light source positioned on one side of said roll of film adapted to project a ray of light towards an edge of said roll of film;

an optical sensor positioned on the other side of said roll of film and aligned with said ray of light;

a repetitive pattern of opaque and translucent areas positioned along the edge of said roll of film through which said ray of light passes, said pattern being adapted to selectively allow the passage of said ray of light through said film as said film moves relative to said light source and optical sensor, the interruption of said ray of light thereby signaling the passage and position of each film frame located on said roll of film relative to said light source and optical sensor.

10. Apparatus as defined in claim 9 wherein said drive means comprises a stepper motor having a sprocket drive capstan adapted to engage sprocket holes located along the edges of said roll of film.

11. Apparatus as defined in claim 10 wherein said stepper motor is adapted to rotate said capstan a fixed rotation in response to a step signal received from said second computing means.

12. Apparatus as defined in claim 11 wherein said stepper motor rotates said capstan three degrees in response to each step signal, and further wherein said stepper motor must be stepped 60 steps in order to move said film one frame.

13. Apparatus as defined in claim 11 wherein said second computing means includes means for varying the frequency of said step signals, means for starting at a low frequency and gradually increasing to a higher frequency, thereby controlling the stepper motor so that it accelerates from a rest position to a maximum speed, means for counting the desired number of frames and means for determining when said roll of film has been moved close to the desired number of frames wherein the second computing means further responds to the frame detection apparatus by gradually decreasing the frequencies of the step signals when said roll of film has been moved close to the desired number of frames, including means to thereby cause the stepper motor to gradually slow down and stop the movement of said roll of film at a point where a desired frame is approximately aligned within the projector means so as to project a desired scene on the target screen.

14. Apparatus as defined in claim 13 wherein said second computing means is adapted to control said stepper motor to automatically align said desired frame within said projector means after said film has been moved by varying the frequency of the step signals as described in claim 13.

15. Apparatus as defined in claim 14 wherein said second computing means further controls said lamp, energizing said lamp only after said frame is properly aligned within said projector means.

16. Apparatus as defined in claim 2 wherein said first and second computing means and said logic means are included within a microprocessor.

17. Apparatus as defined in claim 16 wherein said microprocessor controls a message board that displays appropriate messages to the golf player relative to his or her golf game.

18. Apparatus as defined in claim 17 further including data entry means for allowing the player to input data into the microprocessor related to his or her golf game.

19. Apparatus as defined in claim 18 wherein said data entry means comprises a matrix of switches that are sealed so as to be impervious to liquids and packaged so as to be shock resistant.

20. Apparatus as defined in claim 19 wherein said switches of said switch matrix comprise membrane switches.

* * * * *